US007470161B2

(12) United States Patent
Loui et al.

(10) Patent No.: US 7,470,161 B2
(45) Date of Patent: Dec. 30, 2008

(54) LIFTING BODY WATER JET PROPULSION INLET INDUCTOR

(75) Inventors: Steven Loui, Honolulu, HI (US); Gary Shimozono, Kapolei, HI (US); Robert Gornstein, Kailua, HI (US)

(73) Assignee: Navatek, Ltd., Honolulu, HI (US)

( * ) Notice: Subject to any disclaimer, the term of this patent is extended or adjusted under 35 U.S.C. 154(b) by 39 days.

(21) Appl. No.: 11/724,174

(22) Filed: Mar. 15, 2007

(65) Prior Publication Data

US 2007/0218783 A1 Sep. 20, 2007

Related U.S. Application Data

(60) Provisional application No. 60/782,302, filed on Mar. 15, 2006.

(51) Int. Cl.
*B63H 11/103* (2006.01)

(52) U.S. Cl. ..... 440/47; 114/274; 440/38

(58) Field of Classification Search ..... 114/274–282, 114/67 A, 198; 440/38, 46, 47, 88 M, 66; 60/221; 180/116–120
See application file for complete search history.

(56) References Cited

U.S. PATENT DOCUMENTS

| | | | | |
|---|---|---|---|---|
| 3,283,737 | A * | 11/1966 | Gongwer | 440/40 |
| 3,456,611 | A * | 7/1969 | Johnson | 114/275 |
| 3,763,818 | A | 10/1973 | Davis | 115/11 |
| 3,878,807 | A | 4/1975 | Reskusic | 114/198 |
| 3,948,206 | A | 4/1976 | Tyler | 115/70 |
| 4,274,357 | A | 6/1981 | Dawson | 114/270 |
| 4,457,724 | A | 7/1984 | Miyamoto | 440/38 |
| 4,775,341 | A * | 10/1988 | Tyler et al. | 440/38 |
| 4,989,553 | A | 2/1991 | Kaisha | 114/278 |
| 5,344,345 | A | 9/1994 | Nagata | 440/44 |
| 5,540,605 | A * | 7/1996 | Lin | 440/46 |
| 6,332,816 | B1 | 12/2001 | Tsuchiya et al. | 440/40 |
| 6,631,689 | B2 | 10/2003 | Burg | 114/274 |
| 2002/0029731 | A1 * | 3/2002 | Takahashi | 114/67 A |

* cited by examiner

*Primary Examiner*—Ed Swinehart
(74) *Attorney, Agent, or Firm*—Fitzpatrick, Cella, Harper & Scinto

(57) ABSTRACT

A foil shaped lifting body is attached by means of a strut to the underwater body of a vessel in such a manner as to cause a standing wave to be developed when the vessel is in operation in order that the standing wave will induct water into machinery intakes. The technology of this invention is particularly applicable to the operation of waterjet marine propulsion systems.

12 Claims, 4 Drawing Sheets

LIFTING BODY WATER JET PROPULSION INLET INDUCTOR

This application is based on U.S. Provisional Application No. 60/782,302 filed Mar. 15, 2006.

BACKGROUND OF THE INVENTION

Field of the Invention

The present invention relates to watercraft vessels requiring large quantities of sea water passing through the propulsion machinery and more specifically to watercraft vessels powered by waterjet systems that have the water intakes sufficiently close to the water surface as to have the water supply interrupted by wave action or other separation of the intake from the water surface.

Watercraft vessels powered by waterjet systems typically have a water inlet located at its keel line of the hull. Often this opening is towards the aft portion of the hull and, in planning hulls at or near the free water surface at operational speeds. As a result such systems occasionally suffer from induction of air into the propulsion system caused by separation of the intake from the water surface.

It is an object of the present invention to maintain a substantially continuous flow of water to the water intake of a waterjet propulsion system or the like while the watercraft is operating at operational speeds.

Another object of the invention is to generate a standing wave in the free water surface against the water intake of a watercraft having a water powered propulsion system.

SUMMARY OF THE INVENTION

In accordance with an aspect of the present invention a watercraft vessel is disclosed which includes a hydrodynamic body attached to the vessel's hull in such a manner that a standing wave is created by the water passing over the hydrodynamic body when the watercraft vessel is in operation. The developed standing wave is located to substantially improve the condition by which water is supplied to the water inlet for the watercraft's water powered propulsion machinery particularly when the intake is near to or above the adjacent free-water surface.

High speed craft are typically operated in conditions that reduce the wetted surface in order to reduce drag and therefore are operated at reduced hull draft. This may compromise the degree to which water can be supplied to propulsion machinery for cooling or directly for propulsion as with water jet systems.

It is know that foil-shaped hydrodynamic lifting bodies create standing waves in operation which effectively increase the height of the water over the body by creating a standing wave. Such bodies are disclosed for example in U.S. Pat. No. 7,004,093. Such standing waves may significantly raise the elevation of the sea surface over the body.

In accordance with the present invention such a lifting body is located relative to and below the water intake to position the standing wave such that adequate water is supplied to the propulsion system even when the intake is effectively above the adjacent free water surface. In addition to developing the standing wave the hydrodynamic displacement body provides inertial motion damping when the vessel is at rest, and dynamic lift when the vessel is in operation.

BRIEF DESCRIPTION OF THE DRAWINGS

The foregoing objects and other features and advantages of the present invention will be more fully understood by reference to the following detailed description when read in conjunction with the accompanying drawings wherein like reference numerals refer to like or corresponding elements throughout and wherein.

DETAILED DESCRIPTION OF THE PREFERRED EMBODIMENT

Figure 1:
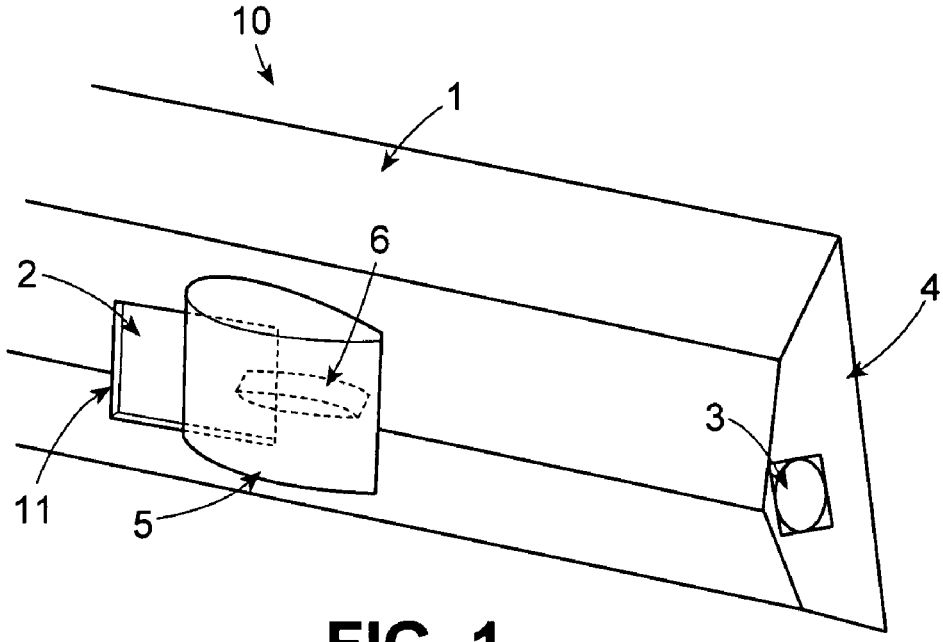
FIG. 1 is a partial perspective bottom view of a watercraft vessel constructed in accordance with the present invention showing a lifting body mounted to the vessel in proximity to its waterjet inlet.

Referring now to the drawings in detail, and initially to FIG. 1, a watercraft vessel 10 constructed in accordance with the present invention is illustrated which includes a main upper platform or hull 1. The hull 1 includes a water intake 2 in the underside of the hull 1 to supply water for the operation of waterjet propulsion or for engine cooling water or other water propulsion system P of known construction shown in dotted lines in FIG. 2.

In waterjet operations propulsion thrust is provided by expelling water entering intake 2 under pressure created by the propulsion system through an outlet port or jet 3, which is located in the transom 4 of the vessel 1. Waterjet operations require large quantities of water to be introduced into the machinery through openings in the hull. When the vessel is operated at design speed planing forces lift the hull and reduce the level of immersion of the waterjet intake 2. If the intake moves above the free water surface level the proper operation of the waterjet may be compromised.

In accordance with the present invention it is possible to have little or no hull immersion, and still use the waterjet propulsion system or supply cooling water to other propulsion machinery through intake 2. This is done by artificially or mechanically increasing the level of the water surface adjacent the intake to keep the water surface in contact with or above the waterjet intake.

Figure 2:
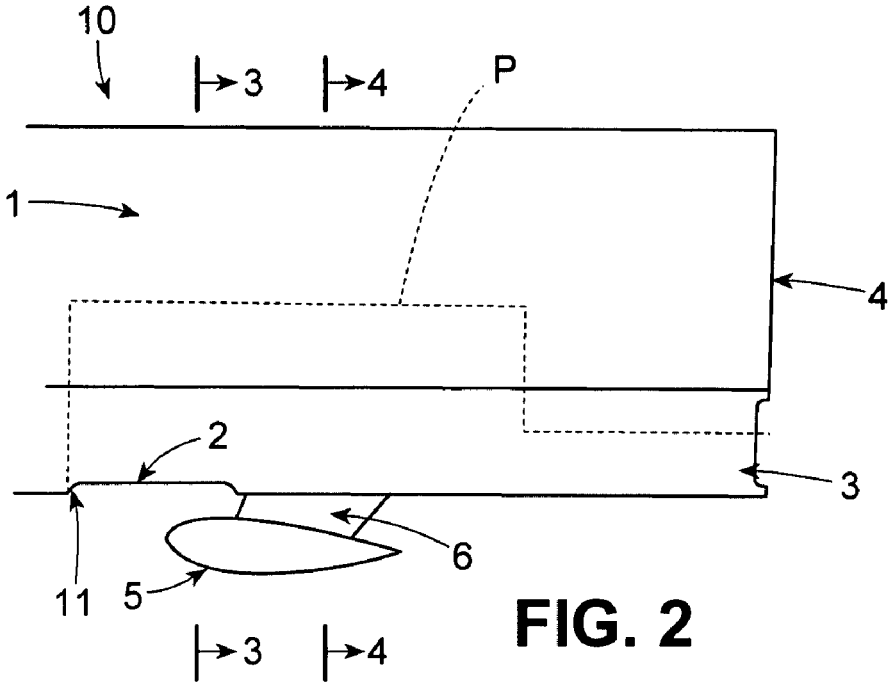
FIG. 2 is a side view of the vessel shown in FIG. 1 showing the leading edge of the lifting body 5 approximately ⅔ of the length of the intake opening 2 from the forward edge of the opening.
Figure 3:
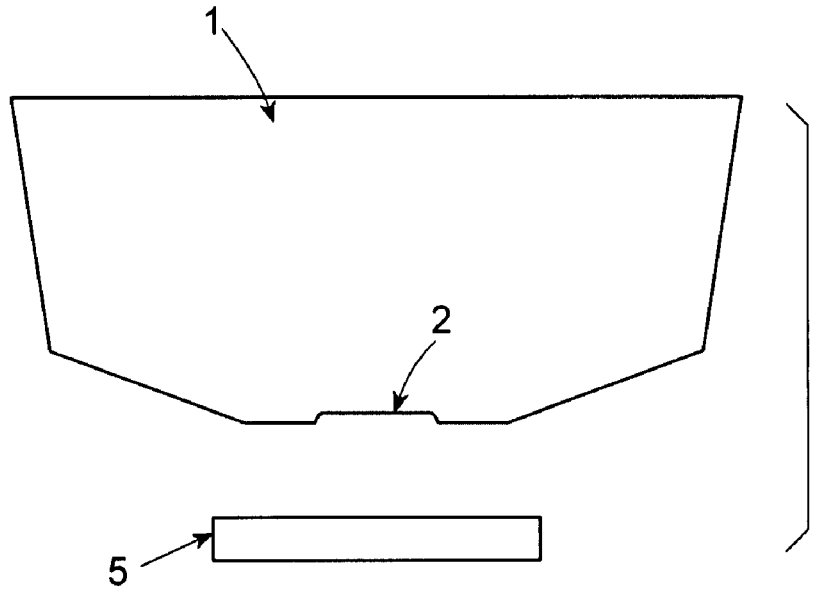
FIG. 3 is a schematic sectional view of the vessel shown in FIG. 1 taken along line 1-1 of FIG. 2, showing the placement of the lifting body 5 relative to the water intake.
Figure 4:
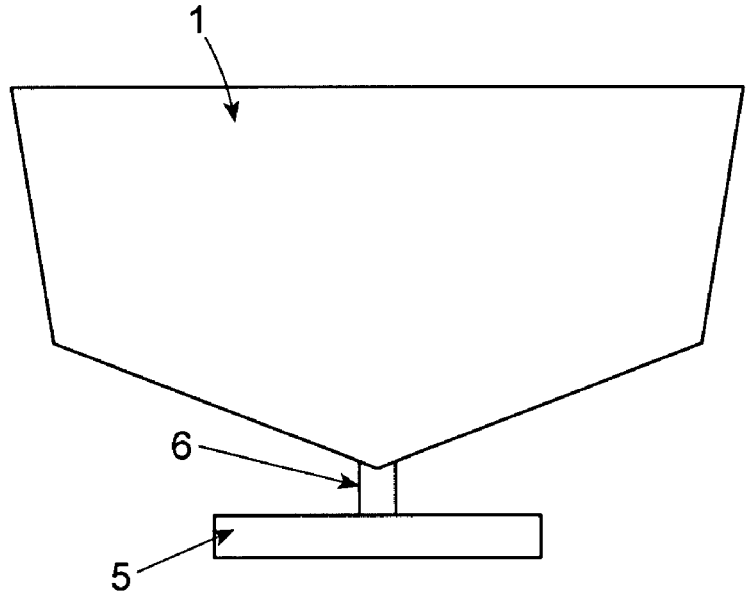
FIG. 4 is a schematic sectional view of the vessel shown in FIG. 1 taken along line 2-2 of FIG. 2, showing the placement of the lifting body 5 and the strut 6 connecting it to the hull 1.

In accordance with the present invention a foil shaped lifting body 5, as disclosed, for example, in U.S. Pat. No. 7,004,093, is secured to a strut 6 below the keel of the vessel as shown in FIG. 4. The lifting body is located such that its leading edge is positioned approximately ⅔ of the length of the intake opening 2 aft of the forward end of the intake as shown in FIG. 2, 3.

As a submerged foil is moved through the water the water is lifted over the surface of the foil, and if the foil is sufficiently close to the surface of the water a standing wave is produced, the crest of which may be some distance above the surface. In this invention the submerged foil is so designed and located as to ensure that the standing wave will supply the waterjet intake.

Figure 5:
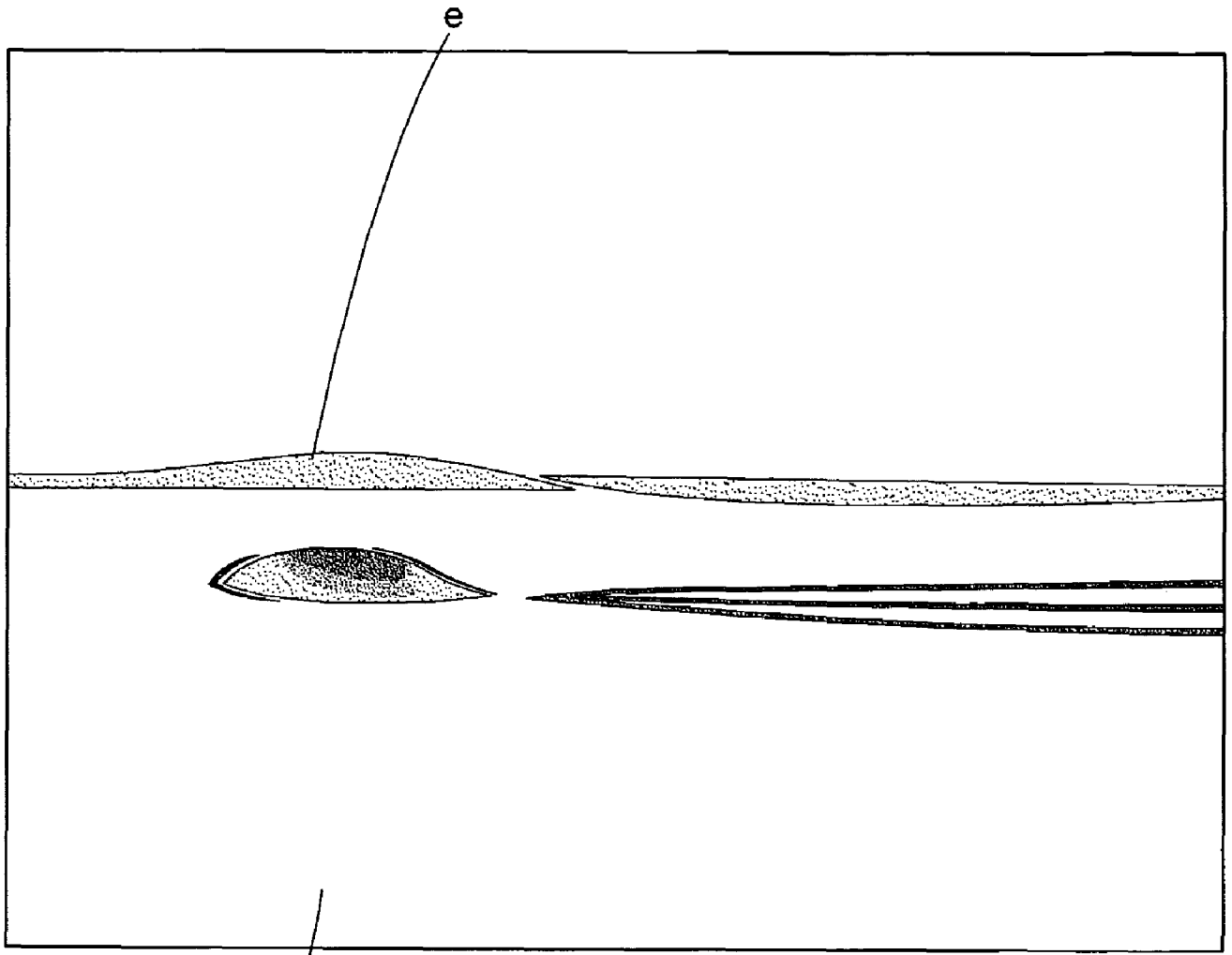
FIG. 5 is a pressure diagram showing water pressure on the lifting body and the standing wave and free water surface above it.
Figure 6:
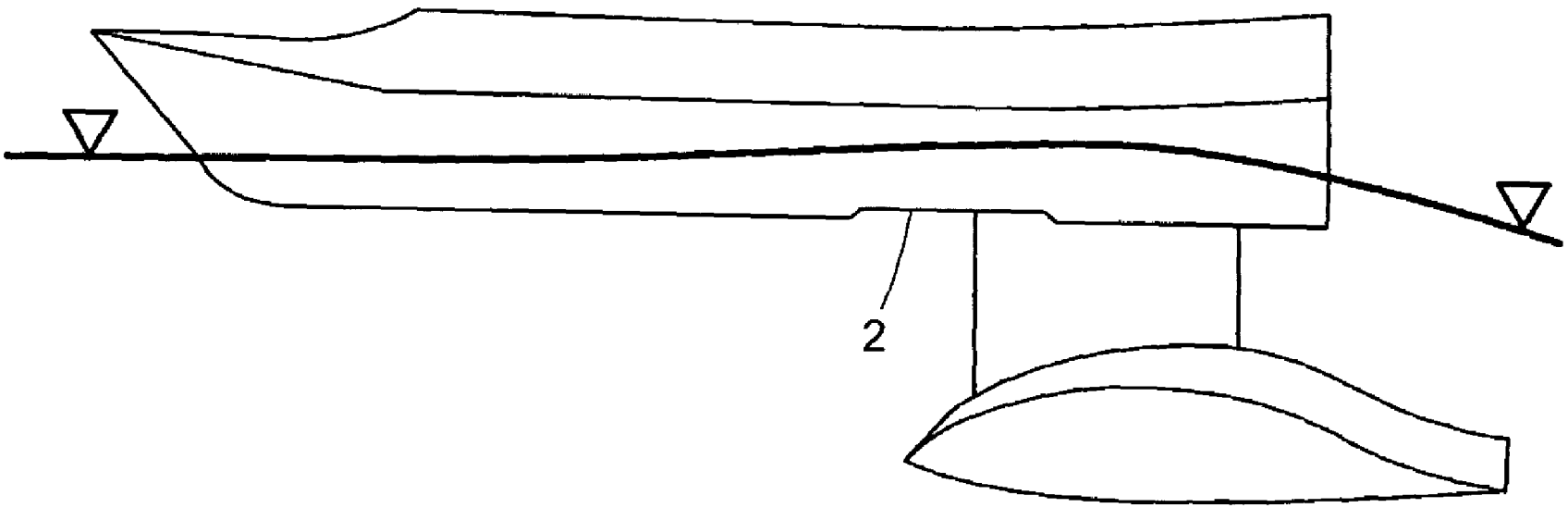
FIG. 6 is a side schematic view of a watercraft vessel and the standing wave created by the lifting body.

This is shown in the schematic illustration of FIG. 6 and the pressure diagram of FIG. 5. On the latter, the density of the speckling reflects higher water pressure.

By varying the size of the inlet 5, the position of the lifting body relative to the inlet, the operational speed range of the vessel, the shape of the lifting body foil and its camber as well as its depth of immersion the size of the standing water wave formed can be controlled, along with the pressure applied to the water below the wave being forced into the intake.

Thus the invention can be adapted to a variety of hull shapes.

Although the invention has been described herein with regard to the specifically illustrated embodiments, it is to be understood that it is not limited to those precise embodiments and that various changes and modifications may be effected therein by those skilled in the art without departing from the scope or spirit of the invention.

What is claimed is:

1. A watercraft hull including a hull bottom located below the design waterline of the hull; waterjet propulsion means in the hull; a water intake port in said hull bottom for supplying water to said waterjet propulsion means; said intake port having fore and aft edges; and lifting body means mounted on said hull adjacent to, below, and spaced from said hull bottom at a deeper waterline depth than said water intake port for creating a standing wave on the free surface of the water adjacent the hull at the intake port for supplying water to the waterjet propulsion means and for producing upward hydrodynamic lift to the hull, said lifting body means being foil shaped in vertical longitudinal cross section and also providing additional buoyancy to the watercraft hull.

2. A watercraft hull as defined in claim 1 wherein said lifting body has a leading edge located beneath and spaced from said water intake port of the hull.

3. A watercraft hull as defined in claim 2 wherein said leading edge of the lifting body is located aft of the fore edge of the intake port a distance approximately two thirds of the distance between the fore and aft edges of said intake port.

4. A watercraft hull as defined in any one of claims 1, 2, and 3 wherein the lifting body is secured to said hull by a singlestrut extending vertically downwardly from the hull bottom and aft of the fore edge of the intake port.

5. A watercraft hull as defined in claim 4 wherein said strut is foil shaped in horizontal longitudinal cross-section.

6. A watercraft hull as defined in claim 5 wherein said lifting body is spaced by said strut from the hull bottom at a distance sufficient for the lifting body to form a standing wave on the surface of the water in which the hull is supported whereby the pressure of the water beneath the hull at the standing wave is increased and water is forced into said intake port.

7. A watercraft hull as defined in any one of claims 1, 2, 3 and 4 wherein said lifting body means comprises a hydrodynamically foil shaped buoyant body for producing buoyant and hydrodynamic lift on the hull while producing said standing wave.

8. A watercraft hull including a hull bottom located below the design waterline of the hull; waterjet propulsion means in the hull; a water intake port in said hull bottom for supplying water to said waterjet propulsion means; said intake port having fore and aft edges; and a lifting body means mounted on said hull adjacent to, below and spaced from the hull bottom and said water port to allow water to flow between the lifting body and the hull bottom; said lifting body means also being positioned at a deeper waterline depth than said water intake port and being sized and shaped as a hydrodynamically foil shaped buoyant body for producing buoyant and hydrodynamic lift on the hull and to produce a standing wave on the free surface of the water adjacent the hull at the intake port for supplying water to the waterjet propulsion means.

9. A watercraft hull as defined in claim 8 wherein said lifting body has a leading edge located beneath and spaced from said water intake port of the hull.

10. A watercraft hull as defined in claim 9 wherein said leading edge of the lifting body is located aft of the fore edge of the intake port a distance approximately two thirds of the distance between the fore and aft edges of said intake port.

11. A watercraft hull as defined in claim 10 wherein the lifting body is secured to said hull by a single strut extending vertically downwardly from the hull bottom and aft of the fore edge of the intake port.

12. A watercraft hull as defined in claim 11 wherein said strut is foil shaped in horizontal longitudinal cross-section.

* * * * *